United States Patent [19]

Wu

[11] Patent Number: 4,944,402

[45] Date of Patent: Jul. 31, 1990

[54] PYRAMID COSMETIC CONTAINER

[75] Inventor: Shui-Kuan Wu, Tainan, Taiwan

[73] Assignee: Fong Yang Plastic Co., Ltd., Tainan, Taiwan

[21] Appl. No.: 460,528

[22] Filed: Jan. 3, 1990

[51] Int. Cl.[5] ..... B65D 6/06

[52] U.S. Cl. ..... 206/581; 132/287; 206/457; 206/501; 206/822; 220/4 D; 312/108

[58] Field of Search ..... 132/286, 287, 300, 318; 190/16; 206/457, 459, 501, 581, 822, 823; 220/4 D, 23.83; 312/108, 204, 270, 285, 292, 293

[56] References Cited

U.S. PATENT DOCUMENTS

| | | | |
|---|---|---|---|
| 224,490 | 2/1880 | Sturges | 220/4 D |
| 823,778 | 6/1906 | Herbeck | 190/16 |
| 1,453,563 | 5/1923 | Albert | 132/287 |
| 1,662,065 | 3/1928 | Kendall | 132/287 |
| 1,667,564 | 4/1928 | Pearson | 206/581 |
| 1,752,948 | 4/1930 | Herrmann | 132/287 |
| 4,203,525 | 5/1980 | Okubo | 206/501 |
| 4,206,842 | 6/1980 | Burridge, Jr. | 206/822 |
| 4,237,097 | 12/1980 | McDuffie | 206/459 |
| 4,412,618 | 11/1983 | LaConte | 132/286 |

*Primary Examiner*—Jimmy G. Foster

*Attorney, Agent, or Firm*—Morton J. Rosenberg; David I. Klein

[57] ABSTRACT

A pyramid cosmetic container of a pyramid structure which is divided into a top housing for retaining a lipstick and a base housing of truncated pyramid in shape including a plurality of compartments in slidable engagement therebetween thus enabling easy access to each of the articles stored therein and is aesthetically attractive.

4 Claims, 7 Drawing Sheets

PYRAMID COSMETIC CONTAINER

BACKGROUND OF THE INVENTION

Compact cosmetic kids or containers are widely used by women to store a variety of cosmetic and toiletry articles. Most available cosmetic containers are able to store only a very small number of related articles including merely, for example, a base portion which houses a particular type of cosmetic and a hinged cover which houses a mirror. Many women carry at least one such known cosmetic container with them at all time, storing a powder and puff, an eye shadow, a rouge or other such product.

Among the many known designs of cosmetic container, many of them show a structure having a plurality of separate compartments. This attempt reflects the desirable properties of containers are compactness, attractiveness, novelty, ease of access to the containers, ability to carry more than one commodity and possibility of obtaining acess to any desired compartment without disturbing or exposing other commodities contained therein.

OBJECTIVE OF THE PRESENT INVENTION

In view of the above, it is an object of the present invention to provide a pyramid cosmetic container that can easily store a plurality of cosmetic, toiletry and other articles.

It is another object of the present invention to provide a compact cosmetic container that will securely retain the plurality of articles stored therein.

It is an additional object of the present invention to provide a pyramid cosmetic container that enables easy access to each of the articles stored therein.

It is a further object of the present invention to provide a pyramid cosmetic container that is asthetically attractive.

DETAILED DESCRIPTION OF THE PREFERRED EMBODIMENT

Figure 1:
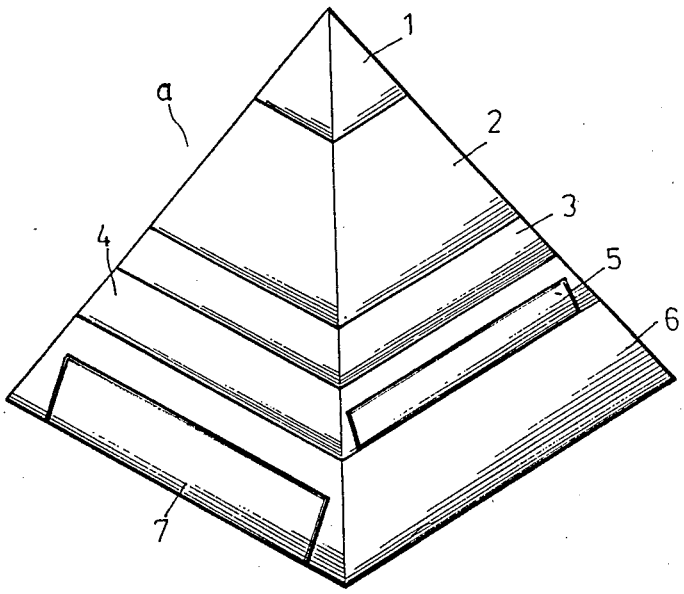
FIG. 1 is a perspective view of a preferred embodiment of the present invention.

The pyramid cosmetic container of this invention is generally indicated by the numeral 9. The container 9 includes a pyramid structure with a square base 65 and four sloping sides meeting upwardly at a point.

The pyramid structure 9 is generally divided into a lipstick unit 1, a top housing 2 and a bottom housing 90. The top housing 2 is a truncated pyramid in shape having a top plate 24 formed with a hole and a cylindrical passage 20 extending downwardly from the hole. The lipstick 1 is provided to be inserted in the top housing 2. As illustrated most clearly in FIGS. 2 & 3, the lipstick 1 is provided with a handle portion 1 of a pyramid in shape which can be readily grasped by the user of container 9. Disposed adjacent the handle 1 is a generally cylindrical locking rim 11 which has a diameter equal to or preferably slightly greater than the diameter of the cylinder of the passage 20. A dispenser 10 for lipstick extends from the locking rim 11. The dispenser 10 is adapted to retain the lipstick 1 and is rotatable with respect to the handle 1 and is provided with appropriate well known internal mechanism to enable the axial advancement of the lipstick relative to the dispenser 10. However, upon complete insertion of the dispenser 10 into the passage 20, the locking rim 11 would engage the passage 20 and the handle 1 seats on the top plate 24 of the housing 2 to form a pyramid top of the entire pyramid structure.

The bottom housing 90 includes a top compartment 3, a middle compartment 4 and a base compartment 6 which are disposed in a shape of truncated pyramid. The top compartment 3 is defined by a base wall 32 and two pairs of opposed side walls having a rear edge 30. The rear edge 30 defines a transverse cylindrical passage that can receive a hinge bar 31 to enable the hinged mounting of top housing 2. The top housing 2 includes a bottom rear edge defined by spaced apart members 21 which are disposed to substantially engage and straddle the rear edge 30 of the top compartment 3. The hinge bar 31 may then be slidably inserted through the rear edge 30 of the top compartment 3 and the members 21 of the top housing 2 to hingedly connect the top housing 2 to the bottom housing 90.

Figure 4:
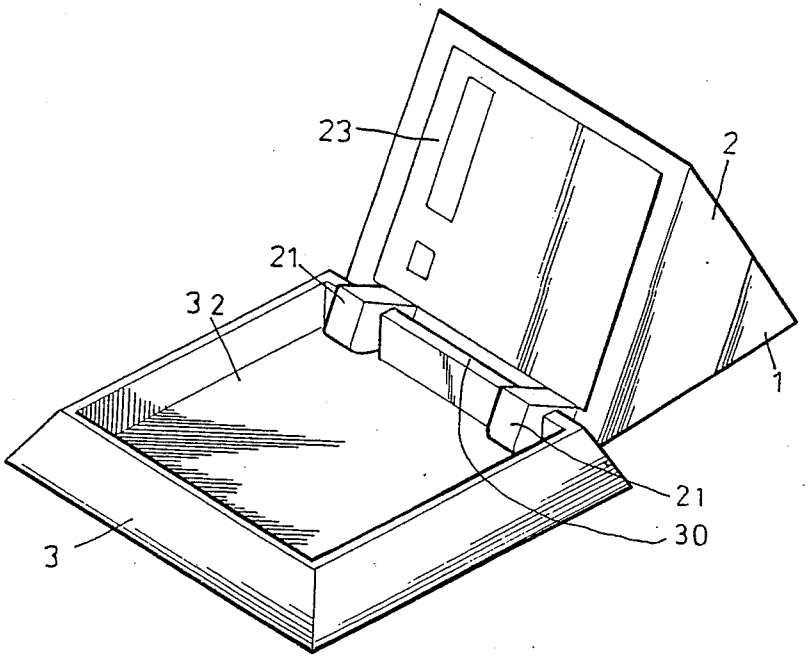
FIG. 4 is a perspective view showing a top portion of the pyramid cosmetic container of this invention.

As shown in FIG. 4, the top housing 2 is provided with a frame (not shown) disposed on the inwardly facing surface thereof. The frame houses a mirror 23 which can be used to facilitate personal grooming with the container 9.

Figure 2:
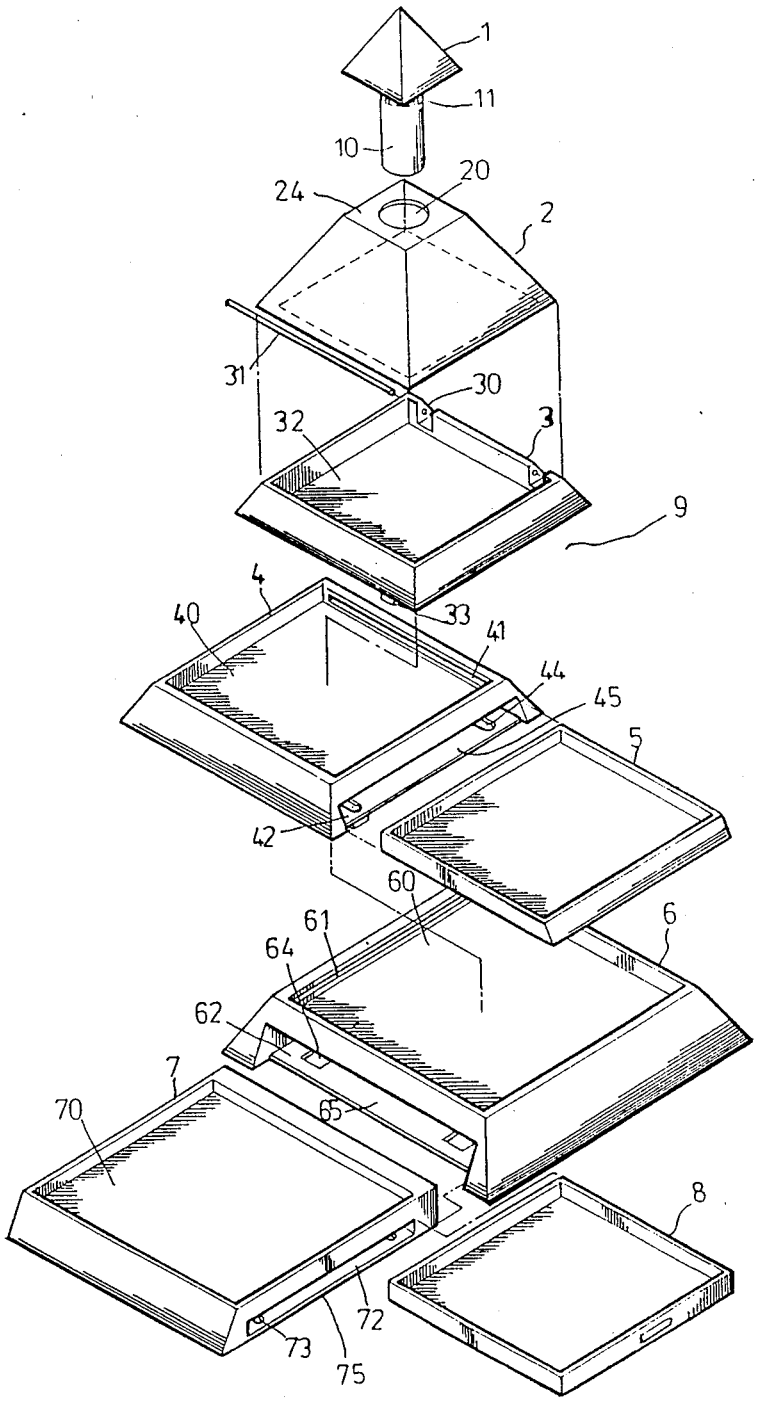
FIG. 2 is an exploded perspective view of the pyramid cosmetic container of the present invention.
Figure 3:
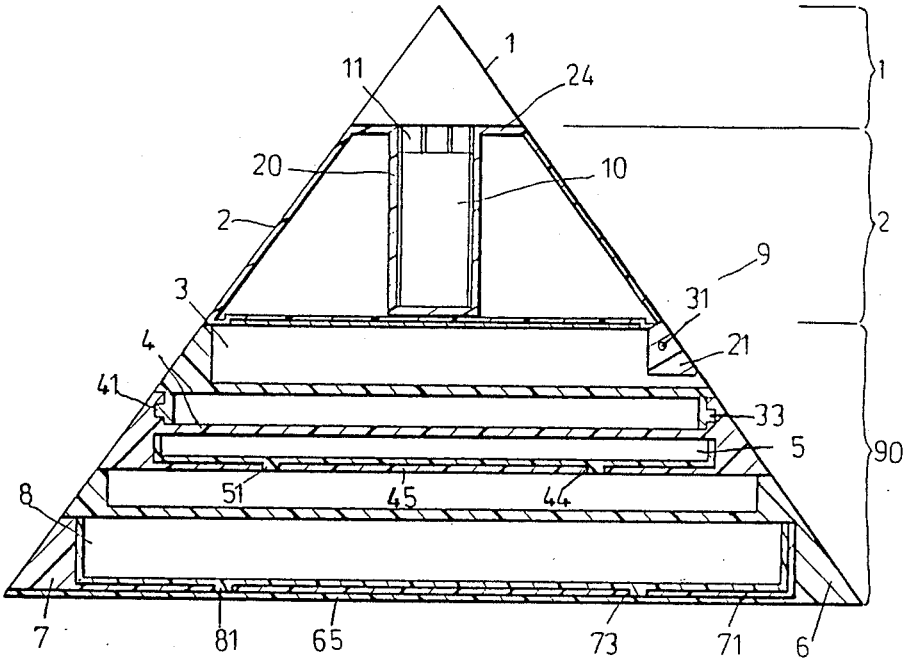
FIG. 3 is a cross-sectional view of the pyramid cosmetic container of the present invention.
Figure 5:
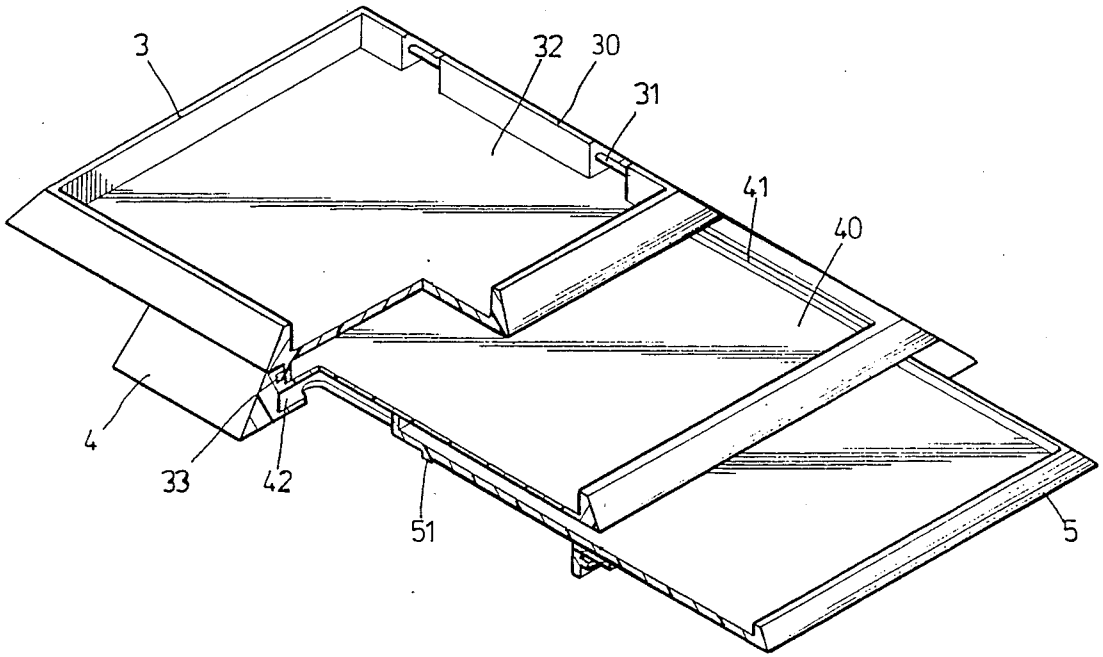
FIG. 5 is a partially broken perspective view showing a middle portion of the pyramid cosmetic container of this invention which is in a deployed state.

The compartment 3 is slidably mounted on the middle compartment 4 as most clearly shown in FIGS. 2 5. The middle compartment 4 is defined by a base plate 40 and two pair of opposed side walls. A pair of side slots 41 are formed in a pair of said opposed side walls but spaced from the base plate 40. The top compartment 3 is further provided with a pair of protrusions 33 which extend downwardly then outwardly from the bottom thereof. The protrusions 33 are slidably engaged in the slots 41 respectively.

Figure 7:
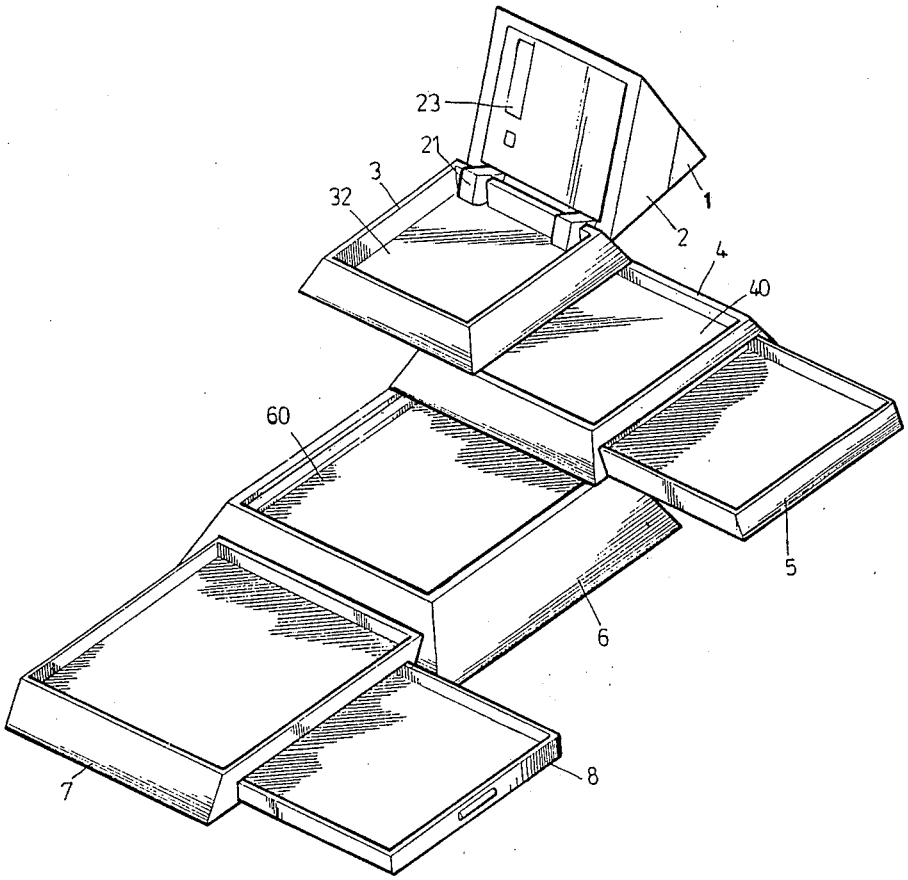
FIG. 7 is a perspective view showing entirely the pyramid cosmetic container of this invention which is in a deployed state.

The middle compartment 4 is further formed with an inner chamber 42 extending inwardly and defined by a pair of opposed side walls, base plate 40 at top and bottom plate 45 at bottom and a rear side wall (not shown). A drawer-like tray 5 is accommodated in the chamber 42 and is adapted to slide in and out of the middle compartment 4. A pair of slots 44 are formed in the bottom plate 45 in a direction substantially parallel to the extension of the slots 41 and the tray 5 is further provided with a pair of protrusions 51 extending downwardly from the bottom thereof. The protrusions 51 are slidably engaged in the slots 44 respectively. Consequently, the top compartment 3, the middle compartment 4 and the tray 5 can be developed in a tiered arrangement, as most clearly shown in FIGS. 2 & 7.

Figure 6:
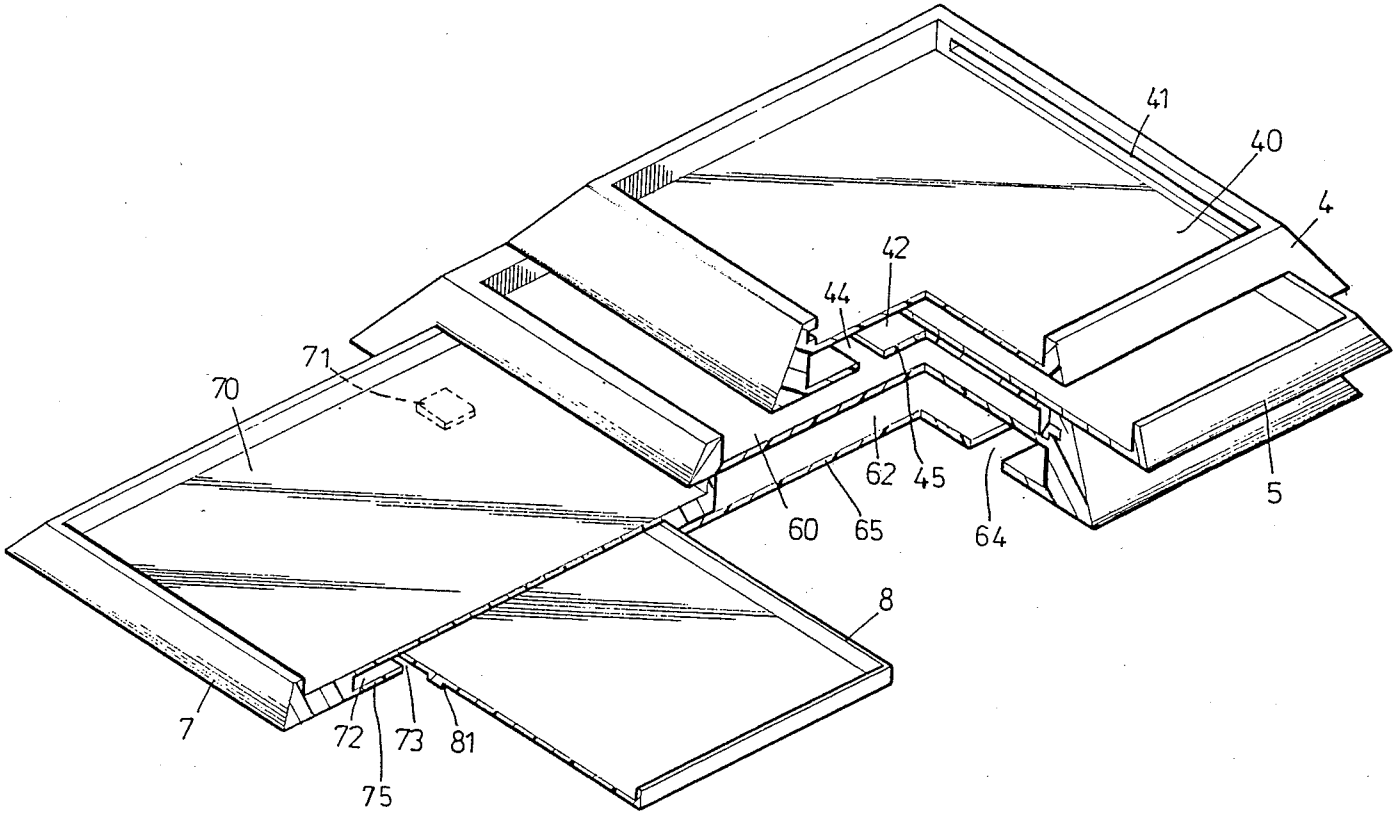
FIG. 6 is a partially broken perspective view showing a base portion of the pyramid cosmetic container of this invention which is in a deployed state.

Similarly, the middle compartment 4 is slidably mounted on the base compartment 6. As shown in FIGS. 5 & 6, the base compartment 6 is defined by a base plate 60 and two pairs of opposed side walls. A pair of side slots 61 extending in a direction substantially perpendicular to the extension of the slots 41 in the middle compartment 4 are formed in a pair of said opposed side walls but spaced from the base plate 60. The middle compartment 4 is further provided with a pair of protrusions 43 which extend downwardly then outwardly from the bottom thereof.

The protrusions 43 are slidably engaged in the slots 61 respectively, thus mounting slidably the middle compartment 4 on the base compartment 6.

The base compartment 6 is further formed with an inner chamber 62 extending inwardly and defined by a pair of opposed side walls, a base plate 60 at top and a bottom plate 65 at bottom and a rear side wall (not shown). A drawer-like tray 7 is accommodated in the chamber 62 and is adapted to slide in and out of the base compartment 6. A pair of slots 64 are formed in the bottom plate 65 in a direction substantially parallel to the extension of the slots 61 in the side walls of the base compartment 6 and the tray 7 is further provided with a pair of protrusions 71 extending downwardly from the bottom thereof. The protrusions 71 are slidably engaged in the slots 64 respectively. Consequently, the middle compartment 4, the base compartment 6 and the tray 7 can also be deployed in a tiered arrangement in a direction perpendicular to the deploying extension of the top compartment 3, the middle compartment 4 and the tray 5.

The tray 7 is further formed with an inner chamber 72 extending inwardly and defined by a pair of opposed side walls, a base plate 70 at top and bottom plate 75 at bottom, and a rear side wall (not shown). A drawer-like tray 8 is accommodated in the chamber 72 and is adapted to slide in and out of the tray 7. A pair of slots 73 are formed in the bottom plate 75 of the tray 7 in a transverse direction relative to the tray 7 and the tray 8 is further provided with a pair of protrusions 81 extending downwardly from the bottom thereof. The protrusions 81 are slidably engaged in the slots 73 respectively.

The container 9 of this invention provides a plurality of trays and containers that can consolidate the various products required to attend to one's personal grooming needs. The front walls of the trays 5, 7 and 8 are preferably configured to conform to the respective sloping side walls of the pyramid.

While the invention has been described with respect to preferred embodiment, it is obvious that various modifications can be made therein without departing from the spirit of the present invention which should be limited only by the scope of the claims.

What is claimed is:

1. A pyramid cosmetic container of a pyramid shape having a base and a plurality of sloping side walls upwardly meeting at a point and comprising:

a base housing of a truncated pyramid in shape including a first compartment defined by a base and a plurality of upstanding side walls; a second compartment defined by a base and a plurality of upstanding side walls and slidably mounted to the first compartment such that in a first position said second compartment covers the first compartment and such that in a second position the second compartment enables access to the first compartment; and a third compartment defined by a base and a plurality of upstanding side walls and slidably mounted to said second compartment and adapted to be slide in a direction perpendicular to the moving direction of the second compartment relative to the first compartment such that in a first position the third compartment covers the second compartment and such that in a second position the third compartment enables access to said second compartment;

a top housing of a truncated pyramid in shape having a base hingedly connected to and adapted to cover the third compartment of the base housing and a top plate formed with a hole and a passage defining a chamber extending downwardly from the hole; and a lipstick unit retained in said passage, including a handle portion of a pyramid in shape seating on the top plate of the top housing and a container portion inserted in the passage.

2. A pyramid cosmetic container as claimed in claim 1 wherein the base of the second compartment of the base housing is formed with a hollow space having an open end in a side wall thereof and a first drawer-like tray having a front wall is provided and is slidably mounted in the hollow space of the base of the second compartment through the open end such that in a first position the first tray is entired stored in the space of the base with its front wall conforming the sloping side wall having the open end of the space and such that in a second position the second compartment of the base housing enables access to the first tray and the sliding direction of the first tray from its first position to its second position is opposite to the sliding direction of the third compartment from its first position to its second position.

3. A pyramid cosmetic container as claimed in claim 1 wherein the base of the first compartment of the base housing is formed with a hollow space having an open end in a side wall thereof, and a second drawer-like tray defined by a front wall, a plurality of side walls and a base is provided and is slidably mounted in the hollow space of the base of the first compartment through the open end thereof such that in a first position the second tray is entirely stored in the space of the base of the first compartment with the front wall of the second tray conforming a sloping side wall having the open end of the space of the base of the first compartment and such that in a second position the first compartment of the base housing enables access to the second tray and the sliding direction of the second tray from its first position to its second position is opposite to the sliding direction of the second compartment from its first position to its second position.

4. A pyramid cosmetic container as claimed in claim 3 wherein the base of the second tray is transversely formed with a hollow space having an open end in a side wall thereof and a third drawer-like tray is provided and slidably mounted in the hollow space of the base of the second tray such that in a first position the third tray is entirely stored in the space of the base of the second tray and such that in a second position the second tray enables access to the third tray.

* * * * *